US005386815A

United States Patent [19]

Ejiri et al.

[11] Patent Number: 5,386,815

[45] Date of Patent: Feb. 7, 1995

[54] ELECTRIC CONTROL APPARATUS FOR PULSE COMBUSTION DEVICE

[75] Inventors: Susumu Ejiri; Hiroshi Nishino, both of Nagoya, Japan

[73] Assignee: Paloma Kogyo Kabushiki Kaisha, Aichi, Japan

[21] Appl. No.: 957,769

[22] Filed: Oct. 16, 1992

[30] Foreign Application Priority Data

Oct. 18, 1991 [JP] Japan ..... 3-299775

[51] Int. Cl.[6] ..... F23C 11/04; A47J 27/00

[52] U.S. Cl. ..... 126/391; 126/351; 431/1; 431/6; 431/31; 431/29; 99/403

[58] Field of Search ..... 431/1, 27, 6, 29, 30, 431/31, 69, 70, 71; 126/350 R, 391, 351; 99/331, 403, 330

[56] References Cited

U.S. PATENT DOCUMENTS 4,445,841 5/1984 Tanaka et al. .

4,808,107 2/1989 Yokoyama et al. ..... 431/1

5,044,929 9/1991 Tabuchi et al. ..... 431/1

*Primary Examiner*—Carl D. Price

*Attorney, Agent, or Firm*—Fisher & Associates

[57] ABSTRACT

An electric control system for a pulse combustion device of the type which includes a combustion chamber mounted within a liquid vessel of a liquid heating apparatus, fuel and air inlet valves arranged to supply a mixture of fuel and air into the combustion chamber, a tailpipe connected at one end thereof to an exhaust port of the combustion chamber to take place therein resonant combustion of the mixture of fuel and air and immersed in an amount of liquid stored in the vessel, and an electrically operated air intake blower arranged to supply fresh air into the combustion chamber through the air inlet valve. The electric control system is designed to activate the air intake blower when a power source switch of the pulse combustion device has been first turn on and maintain activation of the blower for a first predetermined time after ignition of a mixture of fuel and air supplied into the combustion chamber through the inlet valves, to deactivate the blower upon lapse of the first predetermined time, and to activate the blower for a second predetermined time when a fresh mixture of fuel and air is supplied into the combustion chamber and ignited therein to control a temperature of the liquid in the vessel.

3 Claims, 6 Drawing Sheets

ELECTRIC CONTROL APPARATUS FOR PULSE COMBUSTION DEVICE

BACKGROUND OF THE INVENTION

1. Field of the Invention

The present invention relates to an electric control apparatus for a pulse combustion device adapted for use in a liquid heating apparatus such as a water heater of the storage type, a deep fat flyer or the like.

2. Description of the Prior Art

In a conventional pulse combustion device of this kind, flapper-type fuel and air inlet valves are adapted to supply a mixture of gaseous fuel and air into a combustion chamber, and a tailpipe is connected to an exhaust port of the combustion chamber to take place therein resonant combustion of the mixture of gaseous fuel and air and to exhaust therefrom the combustion products. In the case that natural gas is used as the gaseous fuel for the pulse combustion device, the resonant combustion of the gaseous fuel becomes unstable at an initial stage when the combustion device is ignited in its cold condition. If the air flapper valves are stuck due to drops of dew adhered thereto in a cold condition, the supply of air becomes unstable, resulting in misfire of the combustion device.

SUMMARY OF THE INVENTION

It is, therefore, a primary object of the present invention to provide an electric control apparatus for the pulse combustion device capable of stabilizing the supply of air into the combustion device in a cold condition for stable combustion of the mixture of gaseous fuel and air.

According to the present invention, the object is accomplished by providing an electric control apparatus for a pulse combustion device of the type which includes a combustion chamber mounted within a liquid vessel of a liquid heating apparatus, fuel and air inlet valves arranged to supply a mixture of fuel and air into the combustion chamber, a tailpipe connected at one end thereof to an exhaust port of the combustion chamber to take place therein resonant combustion of the mixture of fuel and air and immersed in an amount of liquid stored in the vessel, and an electrically operated air intake blower arranged to supply fresh air into the combustion chamber through the air inlet valve, wherein the electric control system comprises means for activating the air intake blower when a power source switch of the pulse combustion device has been first turn on and for maintaining activation of the blower for a first predetermined time after ignition of a mixture of fuel and air supplied into the combustion chamber through the inlet valves; means for deactivating the blower upon lapse of the first predetermined time, and means for activating the blower for a second predetermined time when a fresh mixture of fuel and air is supplied into the combustion chamber and ignited therein to control a temperature of the liquid in the vessel.

BRIEF DESCRIPTION OF THE DRAWINGS

Additional objects, features and advantages of the present invention will be more readily appreciated from the following detailed description of preferred embodiments thereof when considered with reference to the accompanying drawings, in which.

DESCRIPTION OF THE PREFERRED EMBODIMENTS

Figure 1:
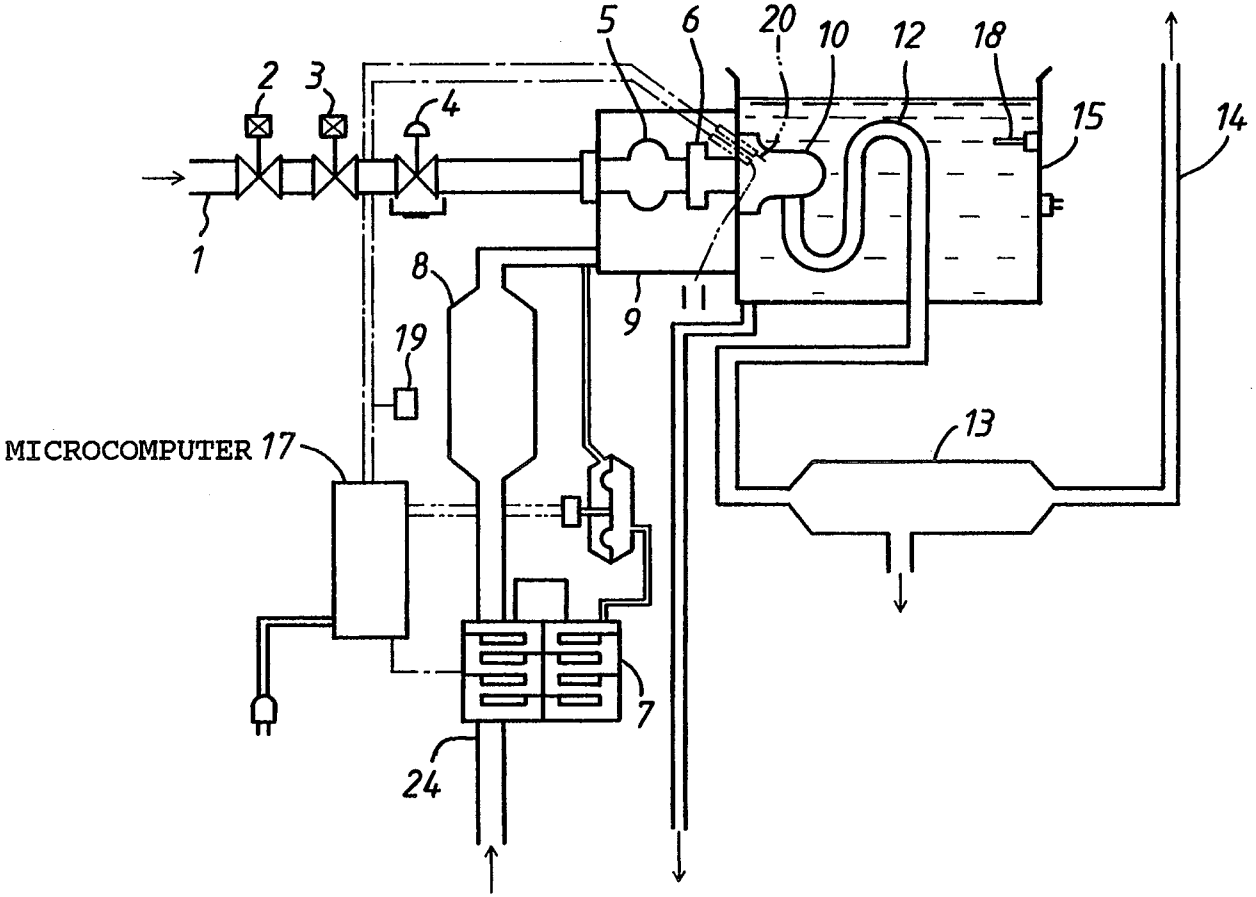
FIG. 1 is a schematic illustration of a pulse combustion device adapted to a deep fat flyer.

Disclosed in FIG. 1 is a pulse combustion device adapted to a deep fat flyer, wherein gaseous fuel from a gas supply pipe 1 is supplied into a gas chamber 5 through electromagnetic valves 2, 3, a gas governor 4 and a flap-per-type gas inlet valve (not shown). The gaseous fuel is equalized in pressure in the gas chamber 5 and supplied into a mixing chamber 6. An air intake blower 7 is provided to forcibly supply fresh air from an intake pipe 24 into an air chamber 9 through an air intake muffler 8. The fresh air is equalized in pressure in the air chamber 9 and supplied into the mixing chamber 6 through a flapper-type air inlet valve (not shown) to be mixed with the gaseous fuel therein. A mixture of gaseous fuel and air is supplied from the mixing chamber 6 into a combustion chamber 10 to be ignited at start up of the pulse combustion device. In this embodiment, the combustion chamber 10 is mounted within a vessel 15 of the fat flyer and connected at its exhaust port to a tailpipe 12 which is immersed in cooking oil in the vessel 15 and connected to an exhaust pipe 14 through an exhaust muffler 13. The combustion chamber 10 is provided with a spark plug 11 and a flame rod 20 which are inserted into the interior of combustion chamber 10. A temperature sensor 18 in the form of a thermister is attached to an internal surface of an upright side wall of vessel 15 to detect an instant temperature $t_o$ of cooking oil stored in the vessel 15.

On start up, the mixture of gaseous fuel and air is ignited by energization of the spark plug 11 in the combustion chamber 10 under operation of the air intake blower 7. When explosive combustion of the mixture takes place at a high temperature in the combustion chamber 10, the gas and air inlet valves are closed by a momentary positive pressure in the combustion chamber 10 to block the reverse flow of combustion products, while the combustion products are exhausted through the tailpipe 12, exhaust muffler 13 and exhaust pipe 14. In this instance, the air intake blower 7 and spark plug 11 are deactivated after resonant combustion of the mixture in the combustion chamber 10 has been ascertained in such a manner as described later. Reignition and combustion are followed by a contraction which produces a momentary negative pressure in the tailpipe 12 for drawing in a fresh supply of gaseous fuel and air through the gas and air inlet valves. During the momentary negative pressure, the flow of combustion products at the exhaust end of tailpipe 12 is reversed.

The fresh charge which has been drawn in during the momentary negative pressure automatically ignites without the need for energization of the spark plug 11, and the explosive combustion repeats itself. Thus, a resonance is established in the tailpipe 12 at a high frequency, for instance, 80–100 times per one minute, and the pulse combustion burner operates as a self-powered burner.

In this embodiment, an electrol control apparatus for the pulse combustion device comprises a controller 17 in the form of a microcomputer which includes a central processing unit or CPU, a read-only memory or ROM, a random access memory or RAM and an interface. The CPU of computer 17 is connected through the interface to a temperature detection circuit and a flame detection circuit (not shown). The temperature detection circuit is connected to the temperature sensor 18 to detect an instant temperature of cooking oil in the vessel 15, and the flame detection circuit is connected to the flame rod 20 to detect presence of a flame in the combustion chamber 10. The CPU of computer 17 is further connected through the interface to an igniter 19 for control of the spark plug 11 and to driving circuits (not shown) respectively for control of the air intake blower 7 and electromagnetic valves 2, 3. The ROM of computer 17 is arranged to memorize a control program illustrated in the form of a flow chart in FIG. 2 and to memorize constants necessary for execution of the program. The RAM of computer 17 is arranged to temporarily memorize various kinds of variables necessary for execution of the control program. The CPU of computer 17 is programmed to execute the control program in response to input signals from the detection circuits thereby to produce output signals for control of the electromagnetic valves 2, 3, the air intake blower and igniter 19 as will be described in detail hereinafter with reference to the flow chart shown in FIG. 2.

Assuming that a power source switch (not shown) has been turned on for activation of the pulse combustion device at step 101 of the program, the CPU of computer 17 determines at step 102 whether an instant temperature $t_o$ detected by sensor 18 is lower than a predetermined high value $t_h$ (for instance, 180° C.). Since the pulse combustion device is still in a cold condition, the CPU of computer 17 determines a "Yes" answer at step 102 and causes the program to proceed to step 103. At step 103, the CPU of computer 17 determines whether a predetermined time $T_4$ (for instance, three hours) has lapsed after the power source switch was previously turned off. Since the power source switch has been first turned on, the CPU of computer 17 determines a "Yes" answer at step 103 and causes the program to proceed to step 104 where the CPU of computer 17 determines whether a predetermined time $T_3$ (for instance, tow hours) has lapsed after finish of previous activation of the pulse combustion device. Since the pulse combustion device is conditioned to be first activated, the CPU of computer 17 determines a "Yes" at step 104 and causes the program to proceed to step 105. At step 105, the CPU of computer 17 produces an output signal for activation of the air intake blower 7 and causes the program to proceed to step 106 where the CPU of computer 17 produces output signals for activation of the electromagnetic valves 2, 3 and igniter 19. Thus, the air intake blower 7 is activated to forcibly supply fresh air into the mixing chamber 6 through the air inlet valve, the electromagnetic valves 2, 3 are opened to supply gaseous fuel into the mixing chamber 6 through the gas inlet valve, and the spark plug 11 is energized under control of the igniter 19 to ignite a mixture of gaseous fuel and air supplied into the combustion chamber 10 from the mixing chamber 6.

When resonant combustion of the mixture takes place in the combustion chamber 10, the CPU of computer 17 is applied with an input signal from the flame detection circuit at step 107 to ascertain presence of a flame in the combustion chamber 10. If the answer at step 107 is "Yes", the program proceeds to step 108 where the CPU of computer 17 produces an output signal for deactivation of the igniter 19. Thus, the spark plug 11 is deenergized under control of the igniter 19. When the program proceeds to step 109, the CPU of computer 17 determines whether a predetermined time $T_1$ (for instance, thirty seconds) has lapsed after deactivation of the igniter 19 at step 18. If the answer at step 109 is "Yes", the CPU of computer 17 produces at step 110 an output signal for deactivation of the air intake blower 7 and causes the program to proceed to step 115. Thus, the air intake blower 7 is deactivated in response to the output signal applied thereto from computer 17. At step 115, the CPU of computer 17 determines whether an instant temperature $t_o$ of cooking oil detected by sensor 18 is higher than the predetermined high value $t_h$. When the instant temperature $t_o$ of cooking oil becomes equal to or higher than the predetermined high value $t_h$, the CPU of computer 17 determines a "Yes" answer at step 115 and causes the program to proceed to step 116 where the CPU of computer 17 produces output signals for deactivation of the electromagnetic valves 2, 3. Thus, the electromagnetic valves 2, 3 are closed to interrupt the supply of gaseous fuel into the mixing chamber 6.

Assuming that the instant temperature $t_o$ of cooking has become lower than the predetermined high value $t_h$ before lapse of the predetermined time $T_3$, the CPU of computer 17 determines a "Yes" answer respectively at step 102 and 103 and determines a "No" answer at step 104. Thus, the program proceeds to step 111 where the CPU of computer 17 produces an output signal for activation of the air intake blower 7. At the following step 112, the CPU of computer 17 produces output signals for activation of the electromagnetic valves 2, 3 and igniter 19. Thus, the air intake blower 7 is activated to forcibly supply fresh air into the mixing chamber 6, the electromagnetic valves 2, 3 are opened to supply gaseous fuel into the mixing chamber 6, and the spark plug 11 is energized under control of the igniter 19 to ignite a mixture of gaseous fuel and air supplied into the combustion chamber 10. When the program proceeds to step 113, the CPU of computer 17 is applied with an input signal from the flame detection circuit to ascertain presence of a flame in the combustion chamber 10. If the answer at step 113 is "Yes", the program proceeds to step **113*a* where the CPU of computer 17 determines whether a predetermined time $T_2$ (for instance, five seconds) has lapsed after detection of the flame at step 113. Upon lapse of the predetermined time $T_2$, the program proceeds to step 114 where the CPU of computer 17 produces output signals for deactivation of the air intake blower 7 and igniter 19**. Thus, the pulse combustion device is activated to operate as a self-powered burner in a stable condition.

Assuming that the instant temperature $T_o$ of cooking oil has become lower than the predetermined high value $t_h$ after lapse of the predetermined time $T_3$, the CPU of computer 17 determines a "Yes" answer respectively at step 102, 103 and 104 and produces output signals for activation of the air intake blower 7, electromagnetic valves 2, 3 and igniter 19, respectively at step 105 and 106. Thus, the combustion chamber 10 is supplied with a mixture of gaseous fuel and air from the mixing chamber 6 as described above, and the spark plug 11 is energized under control of the igniter 19 to ignite the mixture in the combustion chamber 10. When resonant combustion of the mixture takes place in the combustion chamber 10, the CPU of computer 17 is applied with an input signal from the flame detection circuit at step 107 and causes the program to proceed to step 108 where the CPU of computer 17 produces an output signal for deactivation of the igniter 19. Thus, the spark plug 11 is deenergized under control of the igniter 19. Upon lapse of the predetermined time $T_1$ after deactivation of the igniter 19 at step 108, the CPU of computer 17 produces an output signal for deactivation of the air intake blower 7. Thus, the air intake blower 7 is deactivated, and the pulse combustion device operates as a self-powered burner in a stable condition.

Assuming that the power source switch has been turned on before lapse of the predetermined time $T_4$ after the power source switch was previously turned off, the CPU of computer 17 determines a "Yes" answer at step 102 and determines a "No" answer at step 103. Thus, the CPU of computer 17 executes the processings at step 111–114 to activate the air intake blower for the predetermine time $T_2$ after detection of a flame in the combustion chamber 10.

Figure 2:
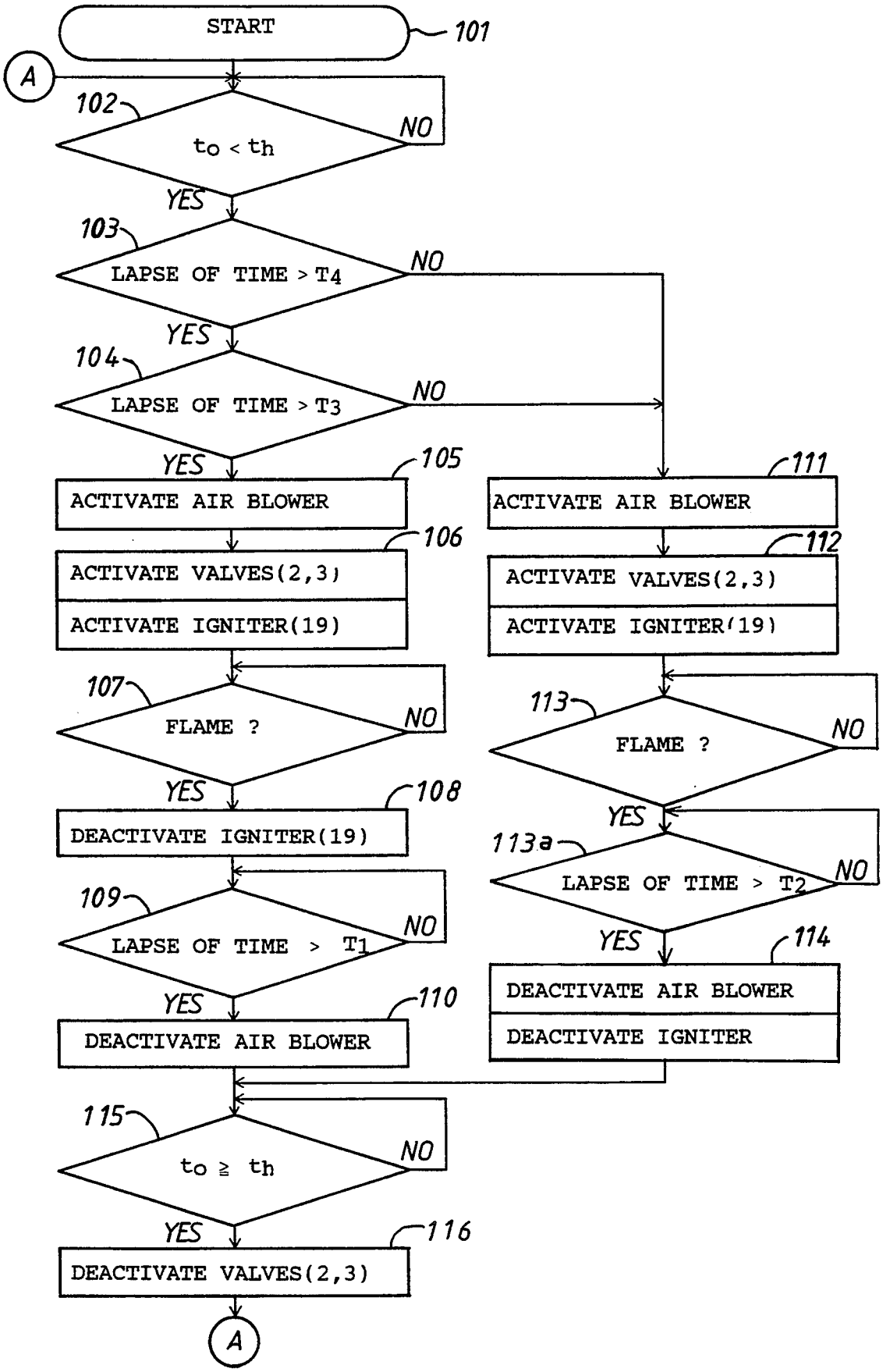
FIG. 2 is a flow chart of a control program executed by a microcomputer shown in FIG. 1.
Figure 3:
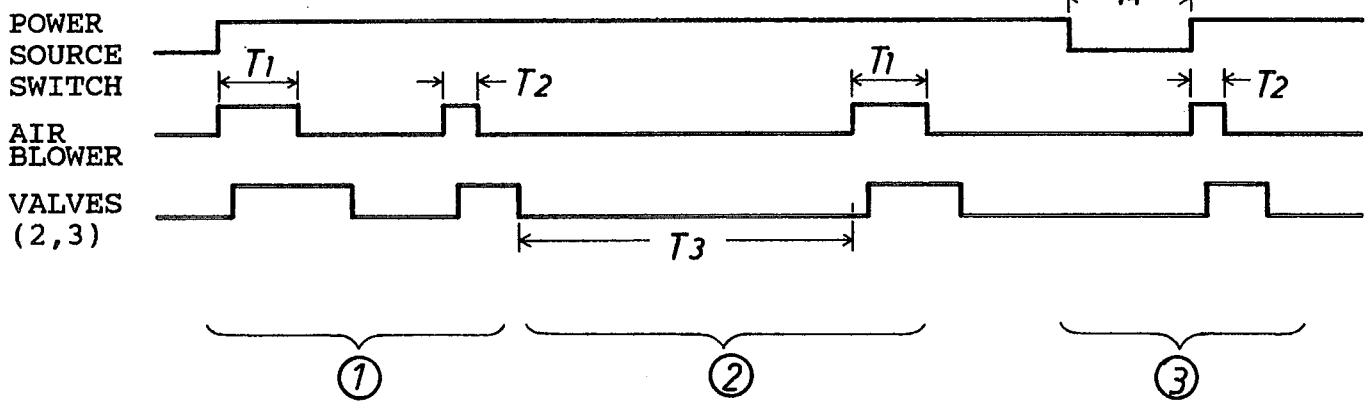
FIG. 3 is a time chart showing each operation of an air intake blower and electromagnetic valves conducted by execution of the control program.
Figure 4:
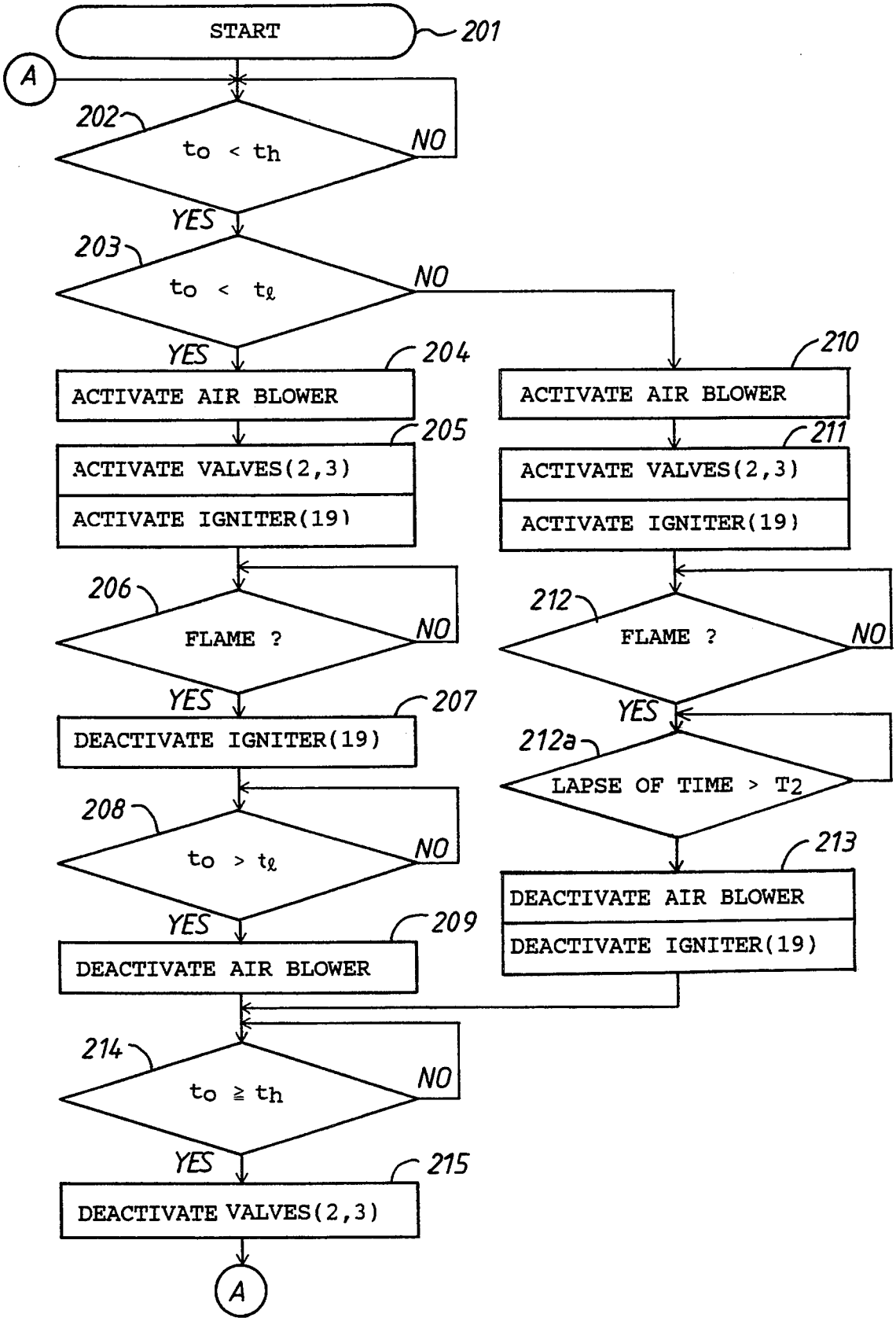
FIG. 4 is a flow chart of a first modification of the control program shown in FIG. 2.

In FIG. 4 there is illustrated a first modification of the control program shown in FIG. 2. In this modification, the CPU of computer 17 is programmed to determine at step 203 whether the instant temperature $t_o$ of cooking oil is lower than a predetermined low value $t_l$ (for instance, 100° C.) and to determine at step 208 whether the instant temperature $t_o$ of cooking oil is higher than the predetermined low value $t_l$. Other processings at step 202, 204–207, 209, 214, 215 and 210–213 are substantially the same as those at step 102,105–108, 110, 115, 116 and 111–114 of the control program shown in FIG. 2.

Figure 5:
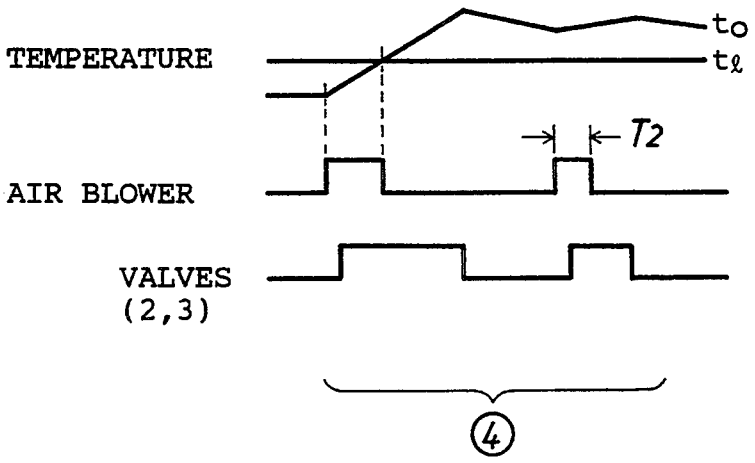
FIG. 5 is a time chart showing each operation of the air intake blower and electromagnetic valves in relation to change of an instant temperature of cooking oil in a vessel of the fat flyer shown in FIG. 1.

Assuming that the power source switch has been turned on for activation of the pulse combustion device at step 201 of the modified control program as described above, the CPU of computer 17 determines a "Yes" answer at step 202 and causes the program to proceed to step 203 where the CPU of computer 17 determines whether the instant temperature of cooking oil detected by sensor 18 is lower than the predetermined low value $t_l$. If the answer at step 203 is "Yes" as shown in FIG. 5, the program proceeds to step 204 where the CPU of computer 17 produces an output signal for activation of the air intake blower 7. Subsequently, the CPU of computer 17 produces output signals for activation of the electromagnetic valves 2, 3 and igniter 19. Thus, the air intake blower 7 is activated to forcibly supply fresh air into the mixing chamber 6, the electromagnetic valves 2, 3 are opened to supply gaseous fuel into the mixing chamber 6, and the spark plug 11 is energized under control of the igniter 19 to ignite a mixture of gaseous fuel and air supplied into the combustion chamber 10 from the mixing chamber 6.

When resonant combustion of the mixture takes place in the combustion chamber 10, the CPU of computer 17 is applied with an input signal from the flame detection circuit at step 206 to ascertain presence of a flame in the combustion chamber 10. If the answer at step 206 is "Yes", the program proceeds to step 207 where the CPU of computer 17 produces an output signal for deactivation of the igniter 19. Thus, the spark plug 11 is deenergized under control of the igniter 19. At the following step 208, the CPU of computer 17 determines whether the instant temperature $t_o$ of cooking oil is higher than the predetermined low value $t_l$. When the instant temperature $t_o$ becomes higher than the predetermined low value $t_l$ as shown in FIG. 5, the CPU of computer 17 determines a "Yes" answer at step 208 and causes the program to proceed to step 209 where the CPU of computer 17 produces an output signal for deactivation of the air intake blower 7. Thus, the air intake blower 7 is deactivated in response to the output signal applied thereto from the CPU of computer 17. After deactivation of the air intake blower 7, the program proceeds to step 214 where the CPU of computer 17 determines whether the instant temperature $t_o$ is higher than the predetermined high value $t_h$. When the instant temperature $t_o$ of cooking oil becomes higher than the predetermined high value $t_h$, the CPU of computer 17 determines a "Yes" answer at step 214 and causes the program to proceed to step 215. At step 215, the CPU of computer 17 produces an output signal for deactivation of the electromagnetic valves 2, 3. Thus, the electromagnetic valves 2, 3 are closed to interrupt the supply of gaseous fuel into the mixing chamber 6.

When the instant temperature $t_o$ of cooking oil becomes lower than the predetermined high value $t_h$ and is maintained higher than the predetermined low value $t_l$, the CPU of computer 17 determines a "Yes" answer at step 202 and determines a "No" answer at step 203. Thus, the CPU of computer 17 executes the processings at step 210–213 to activate the air intake blower 7, electromagnetic valves 2, 3 and igniter 19 and to maintain activation of the air intake blower for the predetermined time $T_2$ after detection of a flame in the combustion chamber 10.

Figure 6:
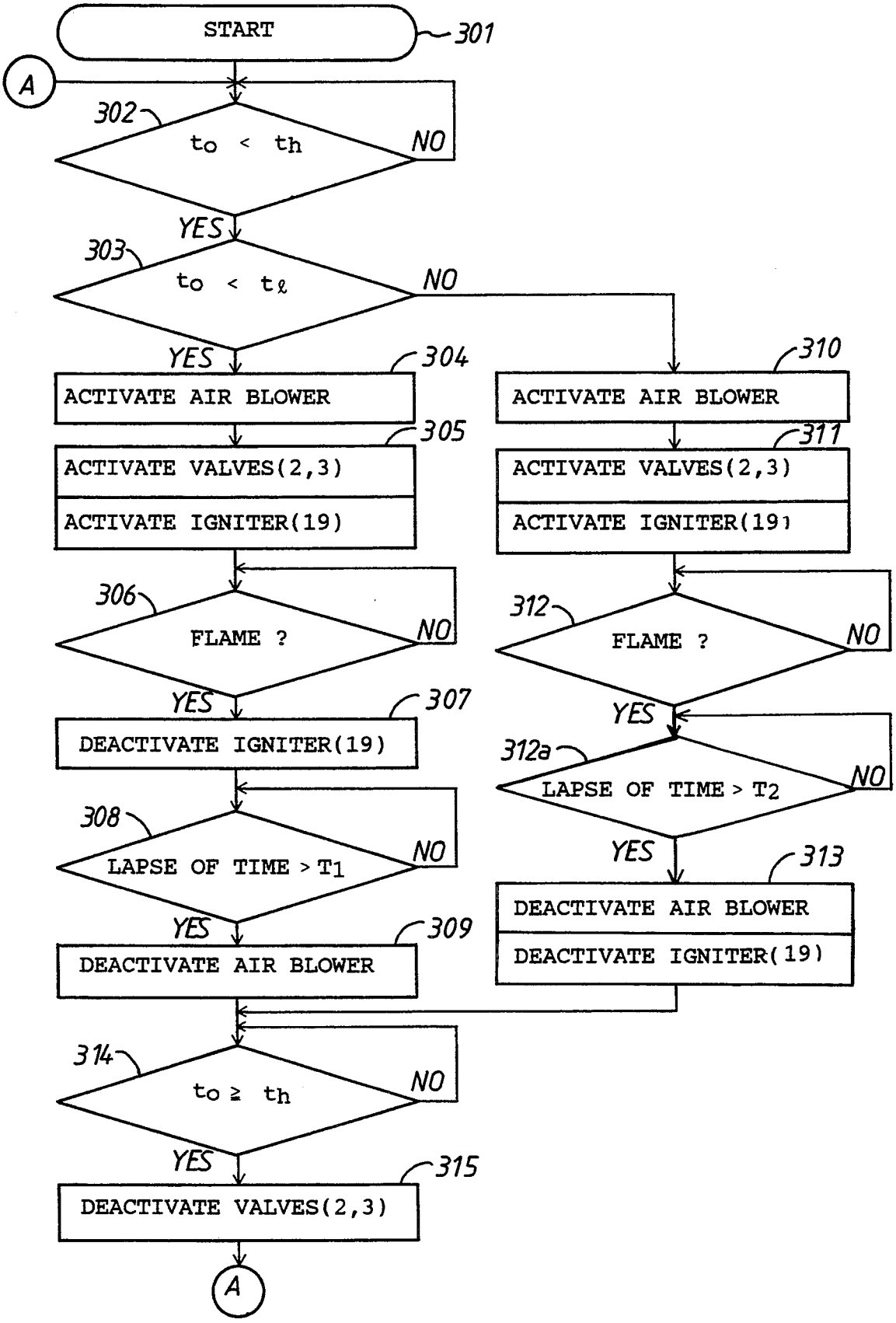
FIG. 6 is a flow chart of a second modification of the control program shown in FIG. 2.

In FIG. 6 there is illustrated a second modification of the control program shown in FIG. 2. In this second modification, the CPU of computer 17 is programmed to determine at step 303 whether the instant temperature $t_o$ of cooking oil is lower than the predetermined low value $t_l$ (for instance, 100° C.) and to determine at step 308 whether the predetermined time $T_1$ has lapsed after detection of a flame in the combustion chamber 10. Other processings at step 302, 304–307, 309, 314, 315 and 310–313 are substantially the same as those at step 102, 105–108, 110, 115, 116 and 111–114 of the control program shown in FIG. 2.

Figure 7:
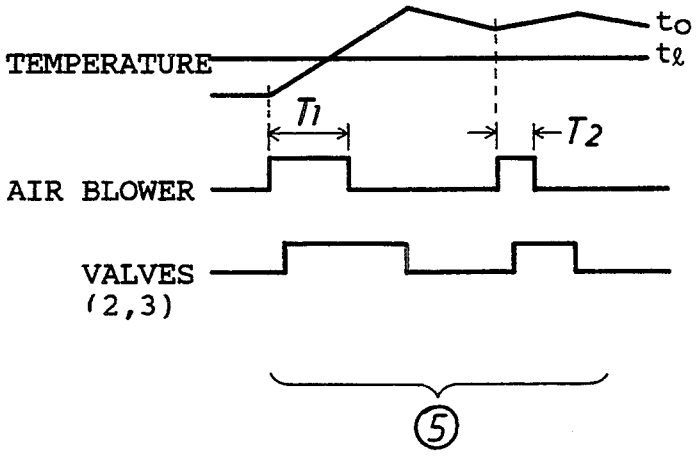
FIG. 7 is a time chart showning each operation of the air intake blower and electromagnetic valves conducted by execution of the modified control program.

Assuming that the power source switch has been turned on for activation of the pulse combustion device at step 301 of the modified control program as described above, the CPU of computer 17 determines a "Yes" answer at step 302 and causes the program to proceed to step 303 where the CPU of computer 17 determines whether the instant temperature $t_o$ of cooking oil is lower than the predetermined low value $t_l$. If the answer at step 303 is "Yes" as shown in FIG. 7, the program proceeds to step 304 where the CPU of computer 17 produces an output signal for activation of the air intake blower 7. Subsequently, the CPU of computer 17 produces output signals for activation of the electromagnetic valves 2, 3 and igniter 19 at step 305. Thus, the air intake blower 7 is activated to forcibly supply fresh air into the mixing chamber 6, the electromagnetic valves 2, 3 are opened to supply gaseous fuel into the mixing chamber 6, and the spark plug 11 is energized under control of the igniter 19 to ignite a mixture of gaseous fuel and air supplied into the combustion chamber 10 from the mixing chamber 6.

When resonant combustion of the mixture takes place in the combustion chamber 10, the CPU of computer 17 is applied with an input signal from the flame detection circuit at step 306 to ascertain presence of a flame in the combustion chamber 10. If the answer at step 306 is "Yes", the program proceeds to step 307 where the CPU of computer 17 produces an output signal for deactivation of the igniter 19. Thus, the spark plug 11 is deenergized under control of the igniter 19. At the following step 308, the CPU of computer 17 determines whether the predetermined time $T_1$ has lapsed after deactivation of the igniter 19. If the answer at step 308, the program proceeds to step 309 where the CPU of computer 17 produces an output signal for deactivation of the air intake blower 7. Thus, the air intake blower 7 is deactivated in response to the output signal applied thereto from the CPU of computer 17. After deactivation of the air intake blower 7, the program proceeds to step 314 where the CPU of computer 17 determines whether the instant temperature $t_o$ is higher than the predetermined high value $t_h$. When the instant temperature $t_o$ of cooking oil becomes higher than the predetermined high value $t_h$, the CPU of computer 17 determines a "Yes" answer at step 314 and causes the program to proceed to step 315. At step 315, the CPU of computer 17 produces an output signal for deactivation of the electromagnetic valves 2, 3. Thus, the electromagnetic valves 2, 3 are closed to interrupt the supply of gaseous fuel into the mixing chamber 6.

When the instant temperature $t_o$ of cooking oil becomes lower than the predetermined high value $t_h$ and is maintained higher than the predetermined low value $t_l$, the CPU of computer 17 determines a "Yes" answer at step 302 and determines a "No" answer at step 303. Thus, the CPU of computer 17 executes the processings at step 310–313 to activate the air intake blower 7, electromagnetic valves 2, 3 and igniter 19 and to maintain activation of the air intake blower for the predetermined time $T_2$ after detection of a flame in the combustion chamber 10 as shown in FIG. 7.

What is claimed is:

1. An electric control apparatus in combination with a pulse combustion device of the type which includes a combustion chamber mounted within a liquid vessel of a liquid heating apparatus, fuel and air inlet valves arranged to supply therethrough a mixture of fuel and air into said combustion chamber, a tailpipe connected at one end thereof to an exhaust port of said combustion chamber and immersed in an amount of liquid stored in said vessel, ignition means arranged to ignite said mixture of fuel and air supplied into said combustion chamber through said fuel and air inlet valves, and an electrically operated air intake blower arranged to supply fresh air into said combustion chamber through said air inlet valve, wherein said electric control apparatus comprises:

detection means for detecting an instant temperature of said liquid in said vessel and for producing an electric signal indicative of the temperature of said liquid;

means responsive to said electric signal from said detection means for activating said air intake blower when said liquid temperature is lower than a predetermined value in a condition where a first predetermined time has lapsed after previous activation of said pulse combustion device;

means for activating said ignition means after activation of said blower;

means for deactivating said ignition means when a flame in said combustion chamber has been detected;

means for maintaining activation of said blower after deactivation of said ignition means for a second predetermined time during which combustion of said mixture is stabilized; and means for deactivating said blower upon lapse of said second predetermined time.

2. An electric control apparatus in combination with a pulse combustion device of the type which includes a combustion chamber mounted within a liquid vessel of a liquid heating apparatus, fuel and air inlet valves arranged to supply therethrough a mixture of fuel and air into said combustion chamber, a tailpipe connected at one end thereof to an exhaust port of said combustion chamber and immersed in an amount of liquid stored in said vessel, and an electrically operated air intake blower arranged to supply fresh air into said combustion chamber through said air inlet valve, wherein said electric control apparatus comprises:

detection means for detecting an instant temperature of said liquid in said vessel and for producing an electric signal indicative of the temperature of said liquid;

means responsive to said electric signal from said detection means for activating said air intake blower when said liquid temperature becomes lower than a predetermined value after previous activation of said pulse combustion device;

means for activating said ignition means after activation of said blower;

means for deactivating said ignition means when a flame in said combustion chamber has been detected;

means for maintaining activation of said blower after deactivation of said ignition means until said liquid temperature becomes said predetermined value; and means for deactivating said blower when said liquid temperature becomes higher than said predetermined value.

3. An electric control apparatus in combination with a pulse combustion device of the type which includes a combustion chamber mounted within a liquid vessel of a liquid heating apparatus, fuel and air inlet valves arranged to supply therethrough a mixture of fuel and air into said combustion chamber, a tailpipe connected at one end thereof to an exhaust port of said combustion chamber and immersed in an amount of liquid stored in said vessel, ignition means arranged to ignite the mixture of fuel and air supplied into said combustion chamber through said fuel and air inlet valves, and an electrically operated air intake blower arranged to supply fresh air into said combustion chamber through said air inlet valve, wherein said electric control apparatus comprises:

detection means for detecting an instant temperature of said liquid in said vessel and for producing an electric signal indicative of the temperature of said liquid;

means responsive to said electric signal from said detection means for activating said air intake blower when said liquid temperature becomes lower than a predetermined value after previous activation of said pulse combustion device;

means for activating said ignition means after activation of said blower;

means for deactivating said ignition means when a flame in said combustion chamber has been detected;

means for maintaining activation of said blower after deactivation of said ignition means for a predetermined time during which combustion of said mixture is stabilized; and means for deactivating said blower upon lapse of said predetermined time.

* * * * *